US010557311B2

(12) United States Patent
Anderle et al.

(10) Patent No.: US 10,557,311 B2
(45) Date of Patent: Feb. 11, 2020

(54) HYBRID DRILL BIT WITH COUNTER-ROTATION CUTTERS IN CENTER

(71) Applicant: HALLIBURTON ENERGY SERVICES, INC., Houston, TX (US)

(72) Inventors: Seth Garrett Anderle, Spring, TX (US); Gregory Grosz, Magnolia, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 124 days.

(21) Appl. No.: 15/741,190

(22) PCT Filed: Jul. 17, 2015

(86) PCT No.: PCT/US2015/040978

§ 371 (c)(1),
(2) Date: Dec. 29, 2017

(87) PCT Pub. No.: WO2017/014730

PCT Pub. Date: Jan. 26, 2017

(65) Prior Publication Data

US 2018/0202231 A1 Jul. 19, 2018

(51) Int. Cl.

| | |
|---|---|
| ***E21B 10/14*** | (2006.01) |
| ***E21B 10/43*** | (2006.01) |
| ***E21B 10/10*** | (2006.01) |
| *E21B 10/18* | (2006.01) |

(52) U.S. Cl.

CPC ..... *E21B 10/14* (2013.01); *E21B 10/10* (2013.01); *E21B 10/43* (2013.01); *E21B 10/18* (2013.01)

(58) Field of Classification Search

CPC ..... E21B 10/14; E21B 10/10; E21B 10/43; E21B 10/18

See application file for complete search history.

(56) References Cited

U.S. PATENT DOCUMENTS

| | | | |
|---|---|---|---|
| 930,759 | A | 8/1909 | Hughes |
| 1,388,424 | A | 8/1921 | George |

(Continued)

FOREIGN PATENT DOCUMENTS

| | | | |
|---|---|---|---|
| CN | 101765695 | A | 6/2010 |
| CN | 101886522 | A | 11/2010 |

(Continued)

OTHER PUBLICATIONS

Korean Intellectual Property Office, International Application PCT/US2015/040978, International Search Report and Written Opinion, dated May 4, 2016, 15 pages, Korea.

China National Intellectual Property Administration, Application No. 201580080865.6, First Office Action and Search Report, dated Nov. 13, 2018, 6 pages.

(Continued)

*Primary Examiner* — Brad Harcourt

(57) ABSTRACT

A hybrid drill bit includes both fixed cutting elements and rotational cutting elements thereon. The fixed cutting elements are affixed to a bit body and define a peripherally-located fixed cutting structure disposed radially outward of the rotational cutting elements. The rotational cutting elements define a centrally-located counter-rotational cutting structure including two hemispherical counter-rotational cutting members mounted for counter-rotation with respect to one another on an axis generally perpendicular to a bit body rotational axis.

18 Claims, 5 Drawing Sheets

(56) References Cited

U.S. PATENT DOCUMENTS 1,394,769 A 10/1921 Sorensen
1,519,641 A 12/1924 Thompson
1,816,568 A 7/1931 Carlson
1,821,474 A 9/1931 Mercer
1,874,066 A 8/1932 Scott et al.
1,879,127 A 9/1932 Schlumpf
1,896,243 A 2/1933 MacDonald
1,932,487 A 10/1933 Scott
2,030,722 A 2/1936 Scott
2,117,481 A 5/1938 Howard et al.
2,119,618 A 6/1938 Zublin
2,198,849 A 4/1940 Waxler
2,216,894 A 10/1940 Stancliff
2,244,537 A 6/1941 Kammerer
2,297,157 A 9/1942 McClinton
2,320,136 A 5/1943 Kammerer
2,320,137 A 5/1943 Kammerer
2,380,112 A 7/1945 Kinnear
2,524,428 A * 10/1950 Day ..... E21B 10/14
175/336
RE23,416 E 10/1951 Kinnear
2,719,026 A 9/1955 Boice
2,815,932 A 12/1957 Wolfram
2,994,389 A 8/1961 Le Bus, Sr.
3,010,708 A 11/1961 Hlinsky et al.
3,050,293 A 8/1962 Hlinsky et al.
3,055,443 A 9/1962 Edwards
3,066,749 A 12/1962 Hildebrandt
3,126,066 A 3/1964 Williams, Jr.
3,126,067 A 3/1964 Schumacher, Jr.
3,174,564 A 3/1965 Morlan
3,239,431 A 3/1966 Knapp
3,250,337 A 5/1966 Demo
3,269,469 A 8/1966 Kelly, Jr.
3,387,673 A 6/1968 Thompson
3,424,258 A 1/1969 Nakayama
3,583,501 A 6/1971 Aalund
RE28,625 E 11/1975 Cunningham
4,006,788 A 2/1977 Garner
4,140,189 A 2/1979 Garner
4,190,126 A 2/1980 Kabashima
4,270,812 A 6/1981 Thomas
4,285,409 A 8/1981 Allen
4,293,048 A 10/1981 Kloesel, Jr.
4,320,808 A 3/1982 Garrett
4,343,371 A 8/1982 Baker, III et al.
4,359,112 A 11/1982 Garner et al.
4,369,849 A 1/1983 Parrish
4,386,669 A 6/1983 Evans
4,410,284 A 10/1983 Herrick
4,428,687 A 1/1984 Zahradnik
4,444,281 A 4/1984 Schumacher, Jr. et al.
4,527,637 A 7/1985 Bodine
4,572,306 A 2/1986 Dorosz
4,657,091 A 4/1987 Higdon
4,664,705 A 5/1987 Horton et al.
4,690,228 A 9/1987 Voelz et al.
4,706,765 A 11/1987 Lee et al.
4,726,718 A 2/1988 Meskin et al.
4,727,942 A 3/1988 Galle et al.
4,738,322 A 4/1988 Hall et al.
4,765,205 A 8/1988 Higdon
4,874,047 A 10/1989 Hixon
4,875,532 A 10/1989 Langford, Jr.
4,892,159 A 1/1990 Holster
4,915,181 A 4/1990 Labrosse
4,932,484 A 6/1990 Warren et al.
4,936,398 A 6/1990 Auty et al.
4,943,488 A 7/1990 Sung et al.
4,953,641 A 9/1990 Pessier
4,976,324 A 12/1990 Tibbitts
4,981,184 A 1/1991 Knowlton et al.
4,984,643 A 1/1991 Isbell et al.
4,991,671 A 2/1991 Pearce et al.
5,016,718 A 5/1991 Tandberg
5,027,912 A 7/1991 Juergens
5,028,177 A 7/1991 Meskin et al.
5,030,276 A 7/1991 Sung et al.
5,049,164 A 9/1991 Horton et al.
5,116,568 A 5/1992 Sung et al.
5,145,017 A 9/1992 Holster et al.
5,176,212 A 1/1993 Tandberg
5,224,560 A 7/1993 Fernandez
5,238,074 A 8/1993 Tibbitts et al.
5,287,936 A 2/1994 Grimes et al.
5,289,889 A 3/1994 Gearhart et al.
5,337,843 A 8/1994 Torgrimsen et al.
5,346,026 A 9/1994 Pessier et al.
5,351,770 A 10/1994 Cawthorne et al.
5,361,859 A 11/1994 Tibbitts
5,429,200 A 7/1995 Blackman et al.
5,439,068 A 8/1995 Huffstutler et al.
5,452,771 A 9/1995 Blackman et al.
5,467,836 A 11/1995 Grimes et al.
5,472,057 A 12/1995 Winfree
5,472,271 A 12/1995 Bowers et al.
5,513,715 A 5/1996 Dysart
5,518,077 A 5/1996 Blackman et al.
5,531,281 A 7/1996 Murdock
5,547,033 A 8/1996 Campos, Jr.
5,553,681 A 9/1996 Huffstutler et al.
5,558,170 A 9/1996 Thigpen et al.
5,560,440 A 10/1996 Tibbitts
5,570,750 A 11/1996 Williams
5,593,231 A 1/1997 Ippolito
5,606,895 A 3/1997 Huffstutler
5,624,002 A 4/1997 Huffstutler
5,641,029 A 6/1997 Beaton et al.
5,644,956 A 7/1997 Blackman et al.
5,655,612 A 8/1997 Grimes et al.
D384,084 S 9/1997 Huffstutler et al.
5,695,018 A 12/1997 Pessier et al.
5,695,019 A 12/1997 Shamburger, Jr.
5,755,297 A 5/1998 Young et al.
5,862,871 A 1/1999 Curlett
5,868,502 A 2/1999 Cariveau et al.
5,873,422 A 2/1999 Hansen et al.
5,941,322 A 8/1999 Stephenson et al.
5,944,125 A 8/1999 Byrd
5,967,246 A 10/1999 Caraway et al.
5,979,575 A 11/1999 Overstreet et al.
5,979,576 A 11/1999 Hansen et al.
5,988,303 A 11/1999 Arfele
5,992,542 A 11/1999 Rives
5,996,713 A 12/1999 Pessier et al.
6,092,613 A 7/2000 Caraway et al.
6,095,265 A 8/2000 Alsup
6,109,375 A 8/2000 Tso
6,116,357 A 9/2000 Wagoner et al.
6,173,797 B1 1/2001 Dykstra et al.
6,220,374 B1 4/2001 Crawford
6,241,034 B1 6/2001 Steinke et al.
6,241,036 B1 6/2001 Lovato et al.
6,250,407 B1 6/2001 Karlsson
6,260,635 B1 7/2001 Crawford
6,279,671 B1 8/2001 Panigrahi et al.
6,283,233 B1 9/2001 Lamine et al.
6,296,069 B1 10/2001 Lamine et al.
RE37,450 E 11/2001 Deken et al.
6,345,673 B1 2/2002 Siracki
6,360,831 B1 3/2002 Akesson et al.
6,367,568 B2 4/2002 Steinke et al.
6,386,302 B1 5/2002 Beaton
6,401,844 B1 6/2002 Doster et al.
6,405,811 B1 6/2002 Borchardt
6,408,958 B1 6/2002 Isbell et al.
6,415,687 B2 7/2002 Saxman
6,439,326 B1 8/2002 Huang et al.
6,446,739 B1 9/2002 Richman et al.
6,450,270 B1 9/2002 Saxton
6,460,635 B1 10/2002 Kalsi et al.
6,474,424 B1 11/2002 Saxman
6,510,909 B2 1/2003 Portwood et al.
6,527,066 B1 3/2003 Rives

| | | | |
|---|---|---|---|
| 6,533,051 | B1 | 3/2003 | Singh et al. |
| 6,544,308 | B2 | 4/2003 | Griffin et al. |
| 6,562,462 | B2 | 5/2003 | Griffin et al. |
| 6,568,490 | B1 | 5/2003 | Tso et al. |
| 6,581,700 | B2 | 6/2003 | Curlett et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,661 | B2 | 8/2003 | Baker et al. |
| 6,601,662 | B2 | 8/2003 | Matthias et al. |
| 6,684,967 | B2 | 2/2004 | Mensa-Wilmot et al. |
| 6,729,418 | B2 | 5/2004 | Slaughter, Jr. et al. |
| 6,739,214 | B2 | 5/2004 | Griffin et al. |
| 6,742,607 | B2 | 6/2004 | Beaton |
| 6,745,858 | B1 | 6/2004 | Estes |
| 6,749,033 | B2 | 6/2004 | Griffin et al. |
| 6,797,326 | B2 | 9/2004 | Griffin et al. |
| 6,823,951 | B2 | 11/2004 | Yong et al. |
| 6,843,333 | B2 | 1/2005 | Richert et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 6,883,623 | B2 | 4/2005 | McCormick et al. |
| 6,902,014 | B1 | 6/2005 | Estes |
| 6,986,395 | B2 | 1/2006 | Chen |
| 6,988,569 | B2 | 1/2006 | Lockstedt et al. |
| 7,096,978 | B2 | 8/2006 | Dykstra et al. |
| 7,111,694 | B2 | 9/2006 | Beaton |
| 7,137,460 | B2 | 11/2006 | Slaughter, Jr. et al. |
| 7,152,702 | B1 | 12/2006 | Bhome et al. |
| 7,197,806 | B2 | 4/2007 | Boudreaux et al. |
| 7,198,119 | B1 | 4/2007 | Hall et al. |
| 7,234,550 | B2 | 6/2007 | Azar et al. |
| 7,270,196 | B2 | 9/2007 | Hall |
| 7,281,592 | B2 | 10/2007 | Runia et al. |
| 7,320,375 | B2 | 1/2008 | Singh |
| 7,350,568 | B2 | 4/2008 | Mandal et al. |
| 7,350,601 | B2 | 4/2008 | Belnap et al. |
| 7,360,612 | B2 | 4/2008 | Chen et al. |
| 7,377,341 | B2 | 5/2008 | Middlemiss et al. |
| 7,387,177 | B2 | 6/2008 | Zahradnik et al. |
| 7,392,862 | B2 | 7/2008 | Zahradnik et al. |
| 7,398,837 | B2 | 7/2008 | Hall et al. |
| 7,416,036 | B2 | 8/2008 | Forstner et al. |
| 7,435,478 | B2 | 10/2008 | Keshavan |
| 7,462,003 | B2 | 12/2008 | Middlemiss |
| 7,473,287 | B2 | 1/2009 | Belnap et al. |
| 7,493,973 | B2 | 2/2009 | Keshavan et al. |
| 7,517,589 | B2 | 4/2009 | Eyre |
| 7,533,740 | B2 | 5/2009 | Zhang et al. |
| 7,568,534 | B2 | 8/2009 | Griffin et al. |
| 7,621,346 | B1 | 11/2009 | Trinh et al. |
| 7,621,348 | B2 | 11/2009 | Hoffmaster et al. |
| 7,703,556 | B2 | 4/2010 | Smith et al. |
| 7,703,557 | B2 | 4/2010 | Durairajan et al. |
| 7,819,208 | B2 | 10/2010 | Pessier et al. |
| 7,836,975 | B2 | 11/2010 | Chen et al. |
| 7,841,426 | B2 | 11/2010 | Zahradnik et al. |
| 7,845,435 | B2 | 12/2010 | Zahradnik et al. |
| 7,845,437 | B2 | 12/2010 | Bielawa et al. |
| 7,847,437 | B2 | 12/2010 | Chakrabarti et al. |
| 8,047,307 | B2 | 11/2011 | Pessier et al. |
| 8,056,651 | B2 | 11/2011 | Turner et al. |
| 8,082,134 | B2 | 12/2011 | Huang |
| 8,141,664 | B2 | 3/2012 | Zahradnik et al. |
| 8,157,026 | B2 | 4/2012 | Kulkarni |
| 8,191,635 | B2 | 6/2012 | Buske et al. |
| 8,336,646 | B2 | 12/2012 | Kulkarni |
| 8,347,989 | B2 | 1/2013 | Buske et al. |
| 8,356,398 | B2 | 1/2013 | McCormick et al. |
| 8,448,724 | B2 | 5/2013 | Buske et al. |
| 8,459,378 | B2 | 6/2013 | Zahradnik et al. |
| 8,678,111 | B2 | 3/2014 | Zahradnik et al. |
| 8,950,514 | B2 | 2/2015 | Buske et al. |
| 8,978,786 | B2 | 3/2015 | Nguyen et al. |
| 9,004,198 | B2 | 4/2015 | Kulkarni |
| 2002/0092684 | A1 | 7/2002 | Singh et al. |
| 2002/0108785 | A1 | 8/2002 | Slaughter, Jr. et al. |
| 2004/0099448 | A1 | 5/2004 | Fielder et al. |
| 2004/0238224 | A1 | 12/2004 | Runia |
| 2005/0087370 | A1 | 4/2005 | Ledgerwood, III et al. |
| 2005/0103533 | A1 | 5/2005 | Sherwood, Jr. et al. |
| 2005/0178587 | A1 | 8/2005 | Witman, IV et al. |
| 2005/0183892 | A1 | 8/2005 | Oldham et al. |
| 2005/0263328 | A1 | 12/2005 | Middlemiss |
| 2005/0273301 | A1 | 12/2005 | Huang |
| 2006/0032674 | A1 | 2/2006 | Chen et al. |
| 2006/0032677 | A1 | 2/2006 | Azar et al. |
| 2006/0162969 | A1 | 7/2006 | Belnap et al. |
| 2006/0196699 | A1 | 9/2006 | Estes et al. |
| 2006/0254830 | A1 | 11/2006 | Radtke |
| 2006/0266558 | A1 | 11/2006 | Middlemiss et al. |
| 2006/0266559 | A1 | 11/2006 | Keshavan et al. |
| 2006/0278442 | A1 | 12/2006 | Kristensen |
| 2006/0283640 | A1 | 12/2006 | Estes et al. |
| 2007/0029114 | A1 | 2/2007 | Middlemiss |
| 2007/0062736 | A1 | 3/2007 | Cariveau et al. |
| 2007/0079994 | A1 | 4/2007 | Middlemiss |
| 2007/0187155 | A1 | 8/2007 | Middlemiss |
| 2007/0221417 | A1 | 9/2007 | Hall et al. |
| 2008/0066970 | A1 | 3/2008 | Zahradnik et al. |
| 2008/0264695 | A1 | 10/2008 | Zahradnik et al. |
| 2008/0296068 | A1 | 12/2008 | Zahradnik et al. |
| 2009/0114454 | A1 | 5/2009 | Belnap et al. |
| 2009/0120693 | A1 | 5/2009 | McClain et al. |
| 2009/0126998 | A1 | 5/2009 | Zahradnik et al. |
| 2009/0159338 | A1 | 6/2009 | Buske |
| 2009/0159341 | A1 | 6/2009 | Pessier et al. |
| 2009/0166093 | A1 | 7/2009 | Pessier et al. |
| 2009/0178855 | A1 | 7/2009 | Zhang et al. |
| 2009/0183925 | A1 | 7/2009 | Zhang et al. |
| 2009/0272582 | A1 | 11/2009 | McCormick et al. |
| 2010/0025119 | A1 | 2/2010 | Stauffer |
| 2010/0224417 | A1 | 9/2010 | Zahradnik et al. |
| 2010/0276205 | A1 | 11/2010 | Oxford et al. |
| 2010/0288561 | A1 | 11/2010 | Zahradnik et al. |
| 2010/0320001 | A1 | 12/2010 | Kulkarni |
| 2011/0024197 | A1 | 2/2011 | Centala et al. |
| 2011/0079440 | A1 | 4/2011 | Buske et al. |
| 2011/0079441 | A1 | 4/2011 | Buske et al. |
| 2011/0079442 | A1 | 4/2011 | Buske et al. |
| 2011/0079443 | A1 | 4/2011 | Buske et al. |
| 2011/0079444 | A1 | 4/2011 | Kulkarni |
| 2011/0120269 | A1 | 5/2011 | McCormick et al. |
| 2011/0162893 | A1 | 7/2011 | Zhang |
| 2013/0220706 | A1 | 8/2013 | Azar et al. |
| 2013/0313021 | A1 | 11/2013 | Zahradnik et al. |
| 2014/0353046 | A1 | 12/2014 | Zhang et al. |

FOREIGN PATENT DOCUMENTS

| | | | |
|---|---|---|---|
| CN | 102434105 | A | 5/2012 |
| EP | 0157278 | A2 | 10/1985 |
| EP | 0225101 | A2 | 6/1987 |
| EP | 0391683 | A1 | 10/1990 |
| EP | 0874128 | A2 | 10/1998 |
| EP | 2089187 | | 8/2009 |
| GB | 2183694 | A | 6/1987 |
| JP | 2000080878 | A | 3/2000 |
| SU | 1331988 | A1 | 8/1987 |
| WO | WO-8502223 | | 5/1985 |
| WO | WO-2008063568 | A1 | 5/2008 |
| WO | WO-2008124572 | A1 | 10/2008 |
| WO | WO-2011043988 | A2 | 4/2011 |
| WO | WO-2013074788 | A1 | 5/2013 |

OTHER PUBLICATIONS

China National Intellectual Property Administration, Application No. 201580080865.6, 2nd Office Action and Search Report, dated Jul. 10, 2019, 8 pages.

China National Intellectual Property Administration, Application No. 201580080865.6, 2nd Office Action and Search Report English Translation, dated Jul. 10, 2019, 7 pages.

* cited by examiner

HYBRID DRILL BIT WITH COUNTER-ROTATION CUTTERS IN CENTER

CROSS-REFERENCE TO RELATED APPLICATIONS

This application is a U.S. national stage patent application of International Patent Application No. PCT/US2015/040978, filed on Jul. 17, 2015, the benefit of which is claimed and the disclosure of which is incorporated herein by reference in its entirety.

BACKGROUND

1. Field of the Invention

The present disclosure relates generally to downhole tools such as drill bits useful in operations related to oil and gas exploration, drilling and production. More particularly, embodiments of the disclosure relate to drill bits including both fixed and rotational cutting elements thereon.

2. Background

Often in operations for the exploration, drilling and production of hydrocarbons, water, geothermal energy or other subterranean resources, a rotary drill bit is used to form a wellbore through a geologic formation. Rotary drill bits may generally be classified as either fixed-cutter drill bits with stationary cutting elements, or roller-cone drill bits with cutting elements mounted on one or more roller cones that are mounted for rotation with respect to a bit body of the drill bit.

Fixed-cutter drill bits are often referred to as "drag bits" and may be constructed with a plurality of fixed cutting elements mounted to the bit body. The bit body for a fixed-cutter drill bit may be constructed of a metallic material such as steel or a matrix material formed by infiltrating a reinforcement material with a molten binder. The fixed cutting elements can be affixed to an outer profile of the bit body such that hard surfaces on the cutting elements are exposed to the geologic formation when forming a wellbore. The cutting elements generally operate to remove material from the geologic formation, typically by shearing formation materials as the drill bit rotates within the wellbore.

Roller-cone drill bits may be constructed of one or more roller cones rotatably mounted to the bit body, wherein cutting elements are disposed on the roller cones. The roller cones roll along the bottom of a wellbore as the roller-cone drill bit is rotated. The cutting elements on the roller cones generally operate to remove material form the geologic material from the geologic formation, typically by crushing, gouging and/or scraping material from the geologic formation to drill the wellbore.

Hybrid drill bits have been developed with features of both fixed-cutter and roller-cone drill bits for various purposes. For example, in some instances, a hybrid drill bit may be more durable, thereby permitting greater depths to be drilled before requiring maintenance or replacement of the drill bit than either a fixed-cutter drill bit or roller-cone drill bit alone.

BRIEF DESCRIPTION OF THE DRAWINGS

The disclosure is described in detail hereinafter on the basis of embodiments represented in the accompanying figures, in which.

DETAILED DESCRIPTION

Figure 1:
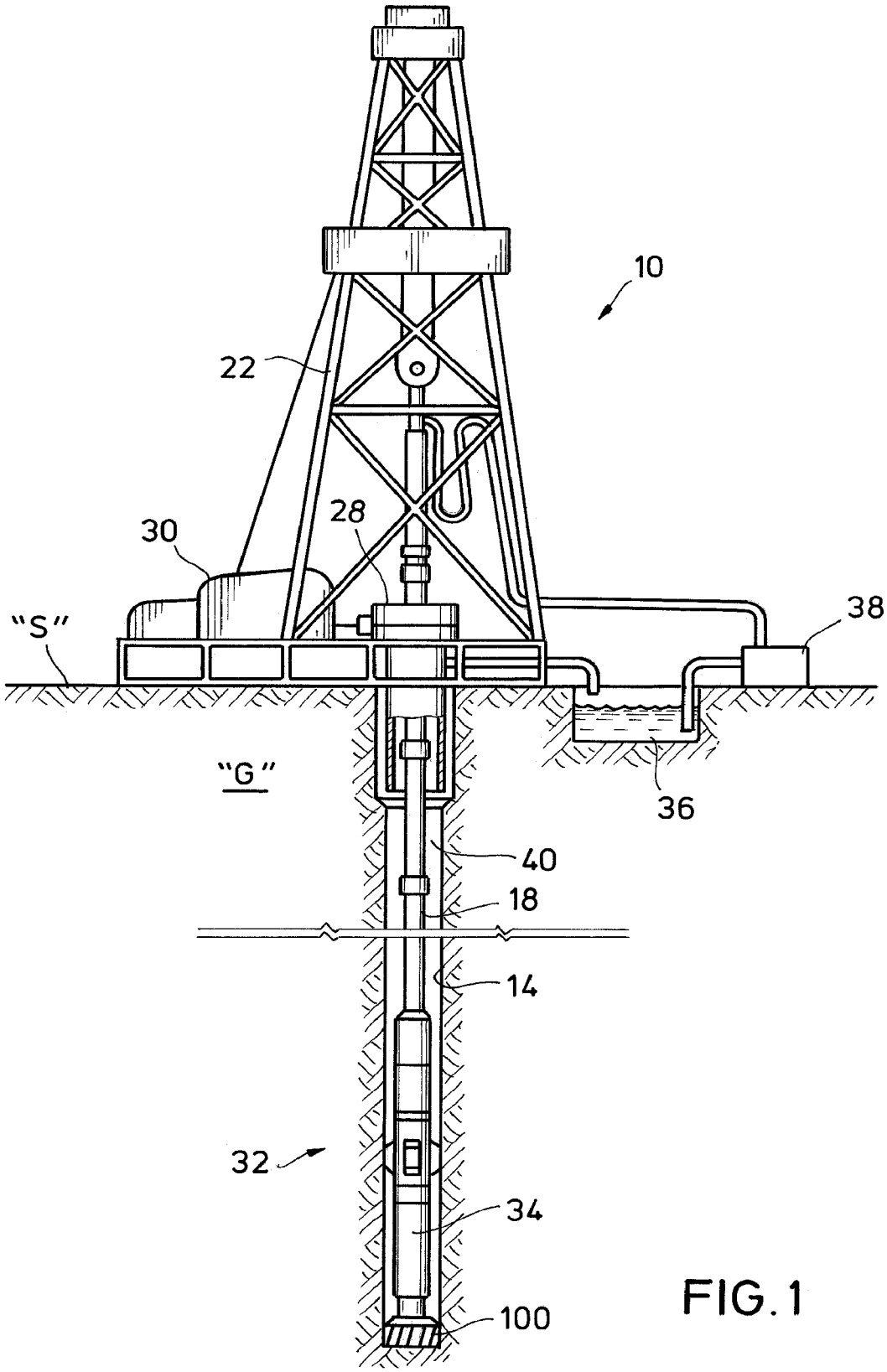
FIG. 1 is a partially cross-sectional side view of a drilling system including a hybrid drill bit constructed in accordance with one or more exemplary embodiments of the disclosure.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a Figure may depict an onshore or terrestrial operation, it should be understood by those skilled in the art that the apparatus according to the present disclosure is equally well suited for use in offshore operations. Further, unless otherwise noted, even though a Figure may depict a wellbore that is partially cased, it should be understood by those skilled in the art that the apparatus according to the present disclosure may be equally well suited for use in fully open-hole wellbores.

1. Description of Exemplary Embodiments

The present disclosure includes hybrid drill bits including fixed cutting elements disposed around a periphery of the drill bits and a pair of counter-rotational cutting members centrally located in the hybrid drill bits. Rotation of the drill bit the carries the peripherally-located fixed cutting elements along a relatively long circumferential path which may facilitate shearing of geologic material from a formation. The pair of counter-rotational cutting members roll in a relatively short circumferential area to crush and scrape geologic material near a rotational axis of the drill bits. The counter-rotational cutting members may be mounted on axes that are generally perpendicular to the rotational axis and may be axially positioned to define a cutting depth of the fixed cutting elements.

FIG. 1 is an elevation view of an example of a drilling system 10 that may incorporate a hybrid drill bit 100 constructed in accordance with one or more exemplary embodiments of the disclosure. The drilling system 10 is partially disposed within a wellbore 14 extending from a surface location "S" and traversing a geologic formation "G." In the illustrated example, the wellbore 14 is shown generally vertical, though it will be understood that the wellbore 14 may include any of a wide variety of vertical, directional, deviated, slanted and/or horizontal portions therein, and may extend along any trajectory through the geologic formation "G."

The hybrid drill bit 100 is provided at a lower end of a drill string 18 for cutting into the geologic formation "G." When rotated, the hybrid drill bit 100 operates to break up and generally disintegrate the geological formation "G." The hybrid drill bit 100 may be rotated in any of a variety of ways. In this example, at the surface location "S" a drilling rig 22 includes a turntable 28 that may be operated to rotate the entire drill string 18 and the hybrid drill bit 100 coupled to the lower end of the drill string 18. The turntable 28 is selectively driven by an engine 30, chain-drive system, or other apparatus. In some embodiments, a bottom hole assembly or BHA 32 provided in the drill string 18 may include a downhole motor 34 to selectively rotate the hybrid drill bit 100 with respect to the rest of the drill string 18. The motor 34 may generate torque in response to the circulation of a drilling fluid, such as mud 36, therethrough. As those skilled in the art will recognize, the ability to selectively rotate the hybrid drill bit 100 relative to the drill string 18 may be useful in directional drilling, and/or for other operations as well.

The mud 36 can be pumped downhole by mud pump 38 through an interior of the drill string 18. The mud 36 passes through the downhole motor 34 of the BHA 32 where energy is extracted from the mud 36 to turn the hybrid drill bit 100. As the mud 36 passes through the BHA 32, the mud 36 may lubricate bearings (not explicitly shown) defined therein before being expelled through nozzles 124 (FIG. 2) defined in the hybrid drill bit 100. The mud 36 flushes geologic cuttings and/or other debris from the path of the hybrid drill bit 100 as it continues to circulate back up through an annulus 40 defined between the drill string 18 and the geologic formation "G." The geologic cuttings and other debris are carried by the mud 36 to the surface location "S" where the cuttings and debris can be removed from the mud stream.

Figure 2:
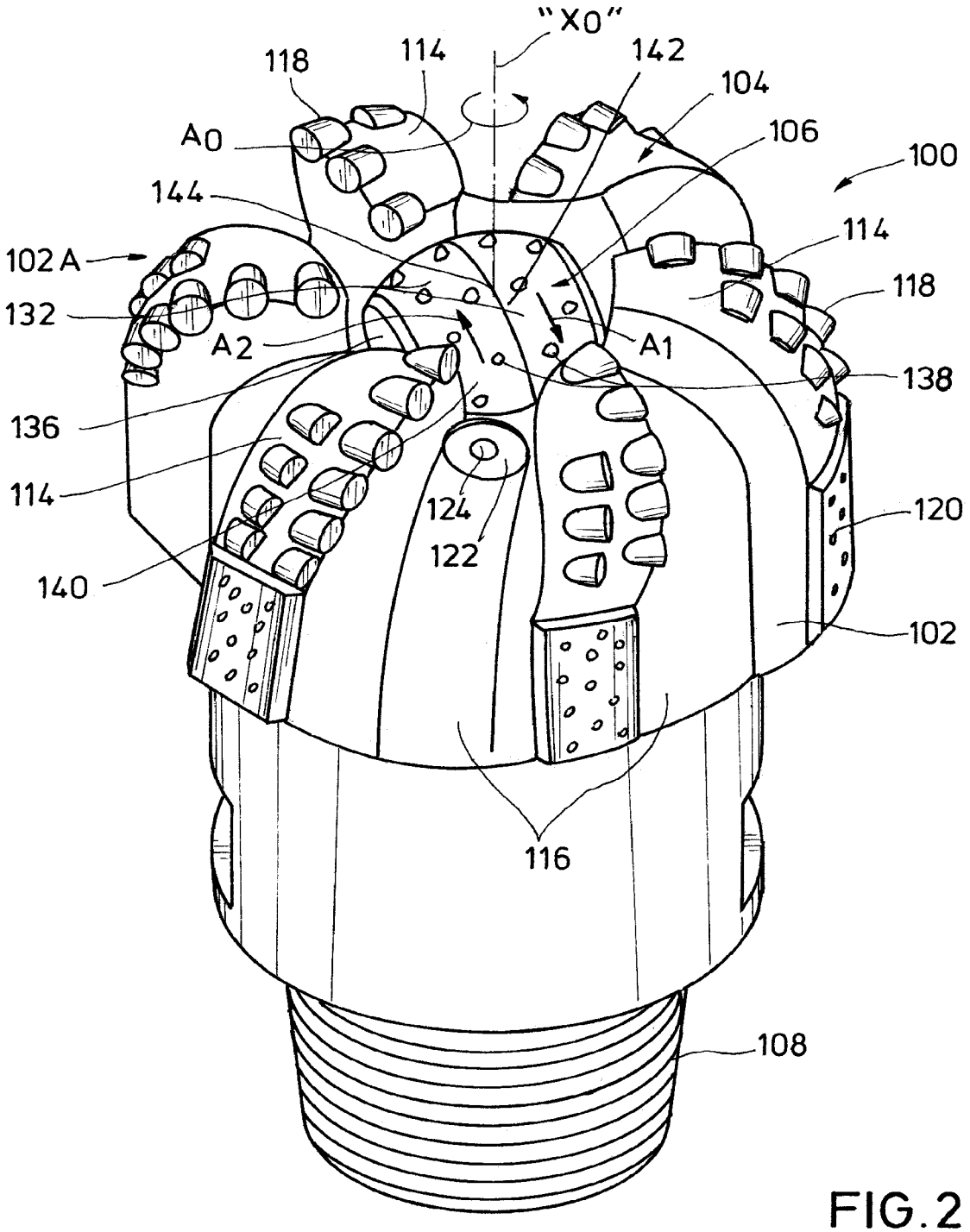
FIG. 2 is a perspective view of the hybrid drill bit of FIG. 1 illustrating a peripherally-located fixed cutting structure defined by a bit body and a centrally-located counter-rotational cutting structure circumscribed by the peripherally-located fixed cutting structure.

FIG. 2 is a perspective view of the hybrid drill 100 illustrating a bit body 102 defining a peripherally-located fixed cutting structure 104 and a centrally-located counter-rotational cutting structure 106 generally circumscribed by the fixed cutting structure 104. Hybrid drill bit 100 may also include any of various types of connectors 108 extending from the bit body 102 for coupling the hybrid drill bit 100 to the drill string 18 (FIG. 1). In some exemplary embodiments, the connector 108 may include a threaded pin with American Petroleum Institute (API) threads defined thereon.

The bit body 102 defines a bit body rotational axis "$X_0$" extending between a leading end 102*a* and a trailing end 102*b* thereof. In some exemplary embodiments, the bit body 102 may be constructed of a metallic material such as steel or any of various metal alloys generally associated with manufacturing rotary drill bits. Alternatively, the bit body 102 may be constructed of matrix material formed by infiltrating a reinforcement material, e.g., tungsten carbide powder with a molten binder material, e.g., copper, tin, manganese nickel and zinc as appreciated by those skilled in the art.

The peripherally-located fixed cutting structure 104 includes a plurality of cutting blades 114 circumferentially spaced about the counter-rotational cutting structure 106 with junk slots 116 defined between the cutting blades 114. In some exemplary embodiments, the six (6) cutting blades 114 are asymmetrically arranged about the bit body rotational axis "$X_0$." The junk slots 116 facilitate the removal of geologic materials and debris from the path of the hybrid drill bit 100, e.g., by providing a flow path for drilling mud 36 (FIG. 1) around the bit body 102.

The cutting blades 114 support a plurality of fixed cutting elements 118 thereon axially and radially spaced about the counter-rotational cutting structure 106. As used herein the term "fixed" generally means that the fixed cutting elements 118 are mounted for maintaining a position and orientation with respect to the bit body 102 as the hybrid drill bit 100 is rotated about the bit body rotational axis "$X_0$." In some embodiments, the fixed cutting elements 118 may be securely mounted to the cutting blades 114 by brazing or other manufacturing techniques recognized in the art. The fixed cutting elements 118 engage and remove adjacent portions of the geologic formation "G" (FIG. 1), generally by shearing the geologic materials from the bottom and sides of a wellbore 14 (FIG. 1) as the hybrid drill bit 100 rotates downhole. In some exemplary embodiments, the fixed cutting elements 118 may include various types of polycrystalline diamond compact (PDC) cutter components.

Gauge elements 120 are provided on radially outward surface at a trailing end of each cutting blade 114. The gauge elements 120 may be constructed of any of the hard materials described above for construction of the fixed cutting elements 118 and operate to maintain a diameter of the wellbore 14 (FIG. 1).

A plurality of nozzle openings 122 are defined in the bit body 102 in one or more exemplary embodiments. Respective nozzles 124 may be disposed in each nozzle opening 122 for expelling various types of drilling fluid or mud 36 (FIG. 1) pumped through the drill string 18 (FIG. 1). The nozzle openings 122 are fluidly coupled to a fluid passageway 128 (FIG. 3) extending through the hybrid drill bit 100. In some embodiments, the centrally-located counter rotational cutting structure 106 may also include nozzles (not explicitly shown) that are fluidly coupled to the fluid passageway 128. The fluid passageway 128 extends through the bit body 102 and the connector 108 such that the fluid passageway 128 may be fluidly coupled to the drill string 18 (FIG. 1).

The centrally-located counter-rotational cutting structure 106 is radially disposed adjacent the bit body rotational axis "$X_0$" such that the counter-rotational cutting structure 106 is generally circumscribed by the fixed cutting structure 104. The counter-rotational cutting structure 106 includes a pair of counter-rotational cutting members 132 rotatably coupled to the bit body 102 by an axle 136. In some exemplary embodiments, the axle 136 is mounted in a fixed position with respect to the bit body 102 and the counter-rotational cutting members 132 are mounted for counter-rotation with respect to one another about the axle 136. Each counter-rotational cutting member 132 is radially displaced from the bit body rotational axis "$X_0$," and thus the counter-rotational cutting members 132 may be induced to rotate on the axle 136 upon rotation of the hybrid drill bit 100. For example, rotation of the hybrid drill bit 100 adjacent the geologic formation "G" (FIG. 1) in the direction of arrow $A_0$ about the bit body rotational axis "$X_0$" induces rotation of a first counter-rotational cutting member 132 in the direction $A_1$ and rotation of a second counter-rotational cutting member 132 in the opposite direction of arrow $A_2$ about the axle 136. The rotation about the axel 136 is due in part to frictional forces between the geologic formation "G" and the counter-rotational cutting members 132 that induce rolling of the of the counter-rotational cutting members 132 along a circumferential path around the bit body rotational axis "$X_0$."

Figure 3:
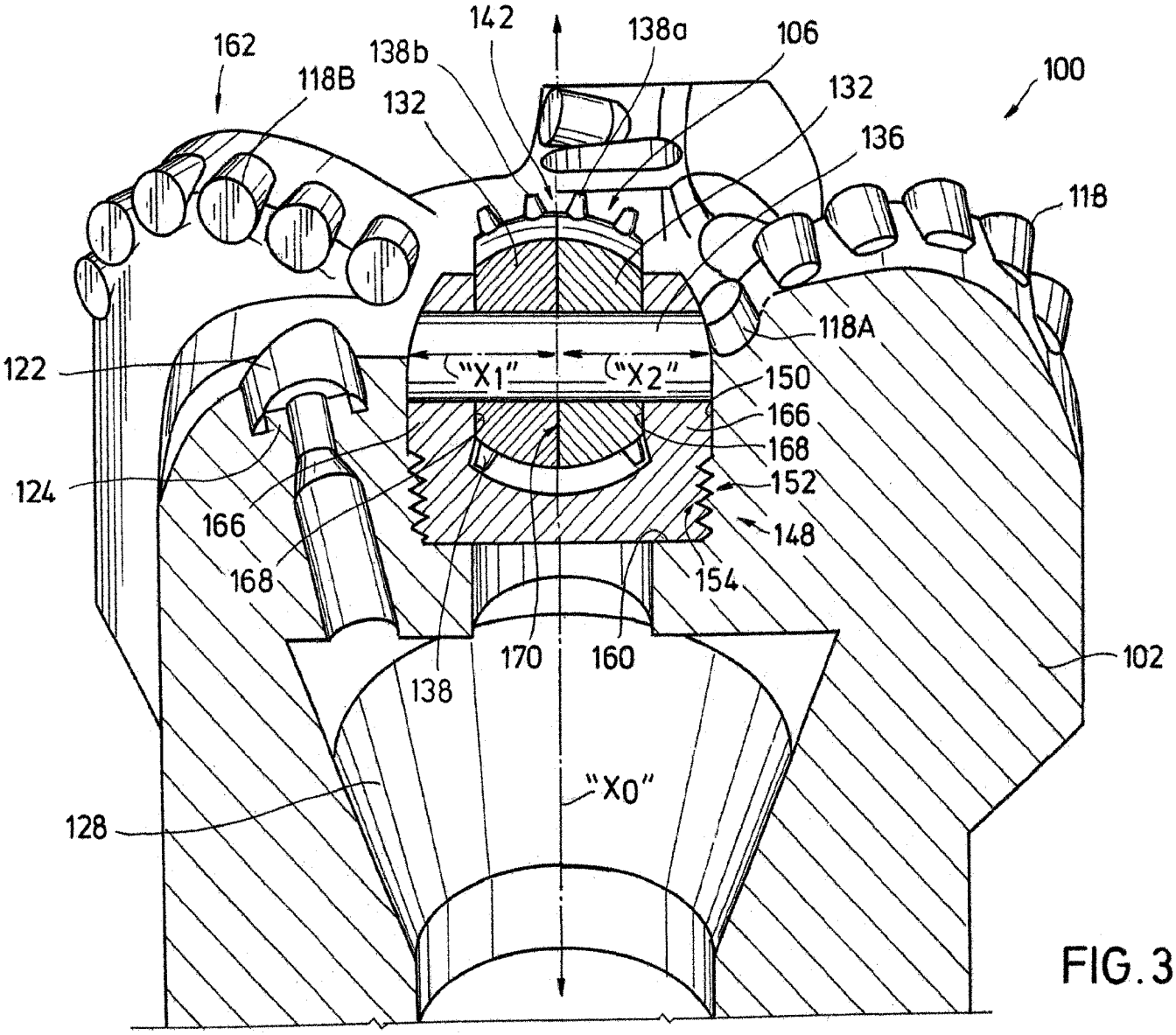
FIG. 3 is a cross-sectional perspective view of the hybrid drill bit of FIG. 2 illustrating the centrally-located counter-rotational cutting structure coupled to the bit body by a coupler disposed within a central aperture defined in the bit body.

The counter-rotational cutting members 132 support cutting elements 138 thereon. The cutting elements 138 may generally operate to crush and scrape geologic material near the bit body rotational axis "$X_0$" of the bit body 102. In the illustrated embodiment, the cutting elements 138 protrude from a generally hemispherical surface 140 of the counter-rotational cutting members 132. The counter-rotational cutting members 132 are arranged such that the respective hemispherical surfaces 140 define a generally spherical profile across a leading end 142 of the counter-rotational cutting structure 106. In some embodiments, an apex 144 of the generally spherical profile is disposed generally along the bit body rotational axis "$X_0$," and in other embodiments the apex 144 is radially offset from bit body rotational axis "$X_0$." In some embodiments, the apex 144 may be radially offset from the bit body rotational axis "$X_0$" such that one of the counter-rotational cutting members 132 intersects the bit body rotational axis "$X_0$" and the counter-rotational cutting members 132 extend to opposite radial sides of the bit body rotational axis "$X_0$." The cutting elements 138 may be arranged in circumferential rows around the hemispherical surfaces 140. To facilitate counter-rotation of the counter-rotational cutting members 132 (e.g., rotation in opposite directions about axle 136) a respective radially inner-most circumferential row 138*a*, 138*b* (FIG. 3) of cutting elements 138 on each of the rotational cutting members 132 may be disposed on opposite radial sides of the bit body rotational axis "$X_0$" as illustrated in FIG. 3. Other arrangements for cutting elements 138 on the counter-rotational cutting members 132 are also contemplated such as dimples or blades in any random or patterned arrangement on the counter-rotational cutting members 132.

FIG. 3 is a cross-sectional perspective view of the hybrid drill bit 100 illustrating the centrally-located counter-rotational cutting structure 106 coupled to the bit body 102 by a coupler 148. The coupler 148 may be disposed within a central aperture 150 defined in the bit body 102, and in this embodiment, the coupler 148 includes an exterior threaded surface 152 defined on the counter-rotational cutting structure 106. The exterior threaded surface 152 engages a corresponding interior threaded surface 154 defined within the central aperture 150. As illustrated, the exterior threaded surface 152 is fully engaged with the internally threaded surface 154 such that the counter-rotational cutting structure 106 abuts an annular shoulder 160 within the aperture 150. In this configuration, the counter-rotational cutting members 132 protrude from the aperture 150 such that the counter-rotational cutting members 132 are generally axially aligned with the fixed cutting elements 118. In some embodiments, the leading end 142 of the counter-rotational cutting members 132 is axially disposed to lead at least one of the fixed cutting elements 118 and to trail at least one of the fixed cutting elements 118. In particular, the leading end 142 is disposed on a leading axial side of a radially-inner-most fixed cutting element 118A and on a trailing axial side of an axially leading-most fixed cutting element 118B.

The axial position of the counter-rotational cutting members 132 defines a cutting depth that may be achieved by the fixed cutting elements 118. Generally, where the counter-rotational cutting members 132 axially lead the fixed cutting elements 118 to a greater extent, a greater portion of axial forces applied to the drill bit 100 may be transferred to the geologic formation "G" (FIG. 1) through the counter-rotational cutting members 132 than through the fixed cutting elements 118. Thus, the fixed cutting elements 118 may achieve a relatively low cutting depth. Conversely, where the counter-rotational cutting members 132 axially lead the fixed cutting elements 118 to a lesser extent, or where the counter-rotational cutting members 132 axially trail the fixed cutting elements 118, a greater portion of axial forces applied to the drill bit 100 may be transferred to the geologic formation "G" through the fixed cutting elements 118 than through the counter-rotational cutting members 132, and thus, the fixed cutting elements 118 may achieve a relatively high cutting depth.

In some other exemplary embodiments (not shown), the counter-rotational cutting structure 106 may be underexposed. For example, the leading end 142 of the of the counter-rotational cutting members 132 may be disposed within the central aperture 150, and in some embodiments, the leading end 142 may be disposed to trail each of the fixed cutting elements. In other embodiments, the counter rotational cutting structure 106 may be overexposed such that the leading end is disposed on a leading axial side of each of the fixed cutting elements 118. In some other exemplary embodiments (not shown), the counter-rotational cutting structure 106 may be secured within the central aperture 150 by other mechanisms including welding, brazing, snap ring, threaded ring, pinning, etc.

The counter-rotational cutting structure 106 includes a pair of parallel axle supports 166 extending therefrom. In some embodiments, the axle supports 166 hold the axle 136 in a fixed or rigid manner generally orthogonal to the bit body rotational axis "$X_0$." Respective roller axes "$X_1$" and "$X_2$" are substantially aligned with one another such that the two counter-rotational cutting members 132 are rotatable about a common axis extending generally perpendicular to the bit body rotational axis "$X_0$." Thrust faces 168 are defined between the axle supports 166 and the counter-rotational cutting members 132, and a thrust face 170 is defined between the counter-rotational cutting members 132. In some embodiments, the thrust faces 168, 170 are arranged in a generally parallel manner with respect to the bit body rotational axis "$X_0$," and thrust faces 168, 170 may include sealed or unsealed bearing components.

2. Example Methods of Operation

With continued reference to FIGS. 1 through 3, the hybrid drill bit 100 may be employed for forming wellbore 14 through geologic formation "G." In some exemplary embodiments, the geologic formation "G" may initially be evaluated to assess an appropriate axial position of the counter-rotational cutting structure 106 with respect to the fixed cutting elements 118. For example, the type of geologic materials within the geologic formation "G" may be assessed to determine an appropriate cutting depth for the fixed cutting elements 118, and a hybrid drill bit 100 with an appropriate axial position of the counter-rotational cutting structure 106 may be selected to achieve the appropriate cutting depth. A weight applied to the fixed cutting elements 118 and a corresponding cutting depth of the stationary cutting elements 118 may be defined by the axial position of the counter-rotational cutting structure 106.

Next, the hybrid drill bit 100 may be coupled to the drill string 18 with the connector 108, and the bit body 102 of the hybrid drill bit 100 may be rotated about the bit body rotational axis "$X_0$" adjacent the geologic formation "G." By rotating the bit body 102, geologic material may be sheared from the geologic formation "G" with the fixed cutting elements 118. The rotation of the bit body 102 causes the counter-rotational cutting members 132 to roll in opposite directions along the geologic formation "G." The first counter-rotational cutting member 132 rolls in the direction of arrow $A_1$, and the second counter-rotational cutting member 132 rolls in the direction of arrow $A_2$. The roller elements 132 both rotate about the axle 136 and axis $A_1$ that is generally orthogonal to the bit body rotational axis "$X_0$." Geologic material from the geologic formation "G" is thereby crushed and scraped with the cutting elements 138 near the bit body rotational axis "$X_0$."

3. Additional Embodiments

Figure 4A:
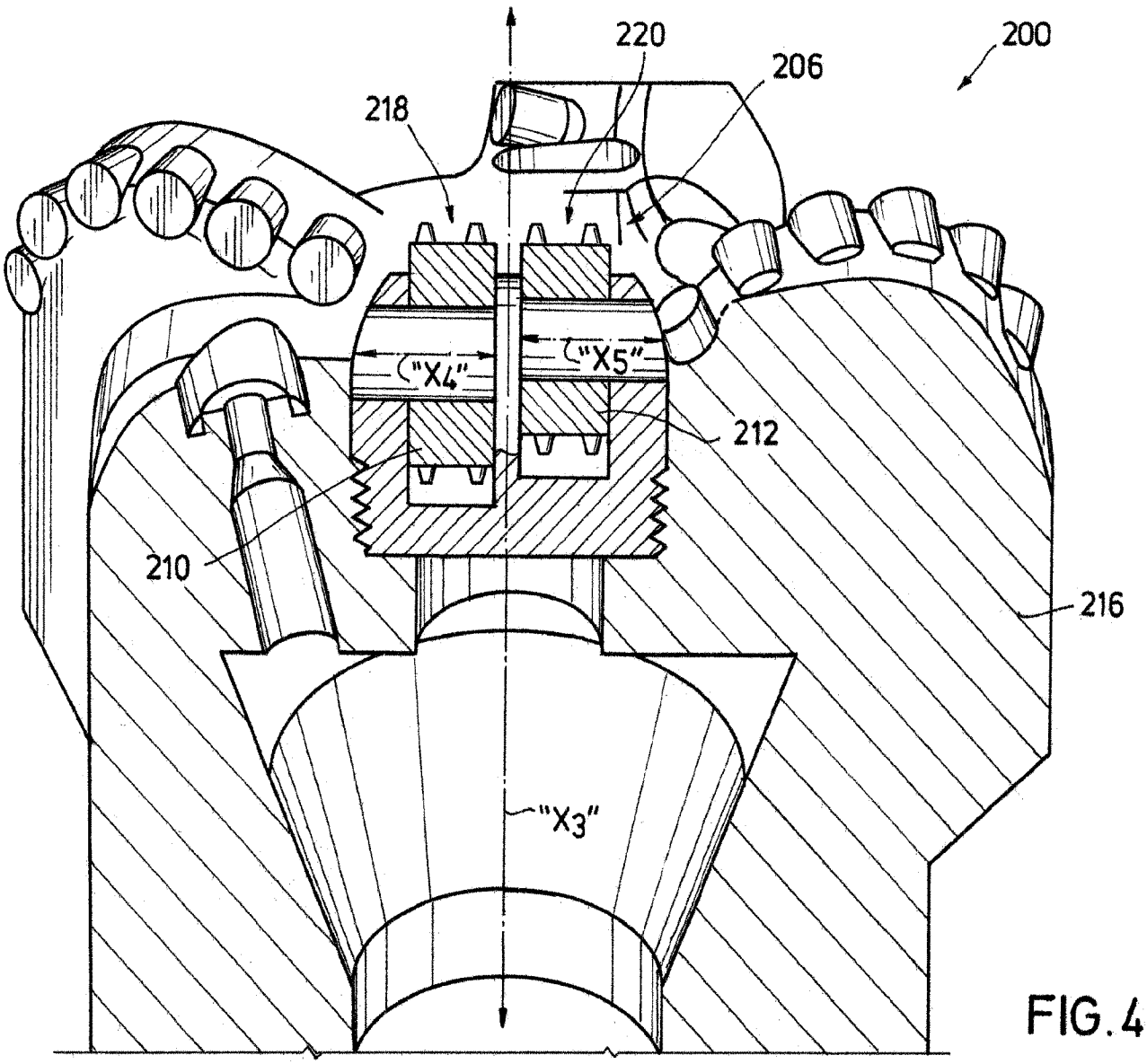
FIG. 4A is a partial cross-sectional view of another example of a hybrid drill bit illustrating a centrally-located counter-rotational cutting structure having a pair of generally cylindrical counter-rotational cutting members rotatable about distinct offset roller axes.

FIG. 4A is a partial cross-sectional view of another example of a hybrid drill bit 200 illustrating a centrally-located counter-rotational cutting structure 206 having a pair of generally cylindrical counter-rotational cutting members 210, 212. The counter-rotational cutting members 210 are both radially displaced from a bit body rotational axis "$X_3$" of a bit body 216 on opposite radial sides of the bit body rotational axis "$X_3$." Thus, the counter-rotational cutting members 210, 212 are mounted for counter-rotation with respect to one another about respective roller axes "$X_4$" and "$X_5$," which are generally perpendicular to the bit body rotational axis "$X_3$." The first cylindrical counter-rotational cutting member 210 has a larger diameter than the second counter-rotational cutting member 212. In this embodiment, the respective roller axes "$X_4$" and "$X_5$," upon which counter-rotational cutting members 210, 212 are supported, are distinct and offset from one another. Specifically, the respective roller axes "$X_4$" and "$X_5$" are axially offset from one another along the bit body rotational axis "$X_5$" such that respective leading ends 218, 220 of the counter-rotational cutting members 210, 210 are axially aligned. In some other embodiments (not shown), the leading ends 218, 220 may be axially offset from one another.

In one or more other embodiments (not shown) distinct and offset roller axes for rotational cutting members may be offset from one another in other directions than the axial direction defined by a rotational axis of a bit body. For example roller axes in other embodiments may be laterally, radially, angularly and/or circumferentially offset from one another. In some exemplary embodiments (not shown), distinct roller axes are arranged at right angles to one another, and/or at oblique angles with to one another in the same plane generally orthogonal to the bit body axis and/or within axially offset planes generally orthogonal to the bit body axis. In some embodiments (not shown) distinct roller axes are arranged such that the roller axes do not intersect the bit body rotational axis.

Figure 4B:
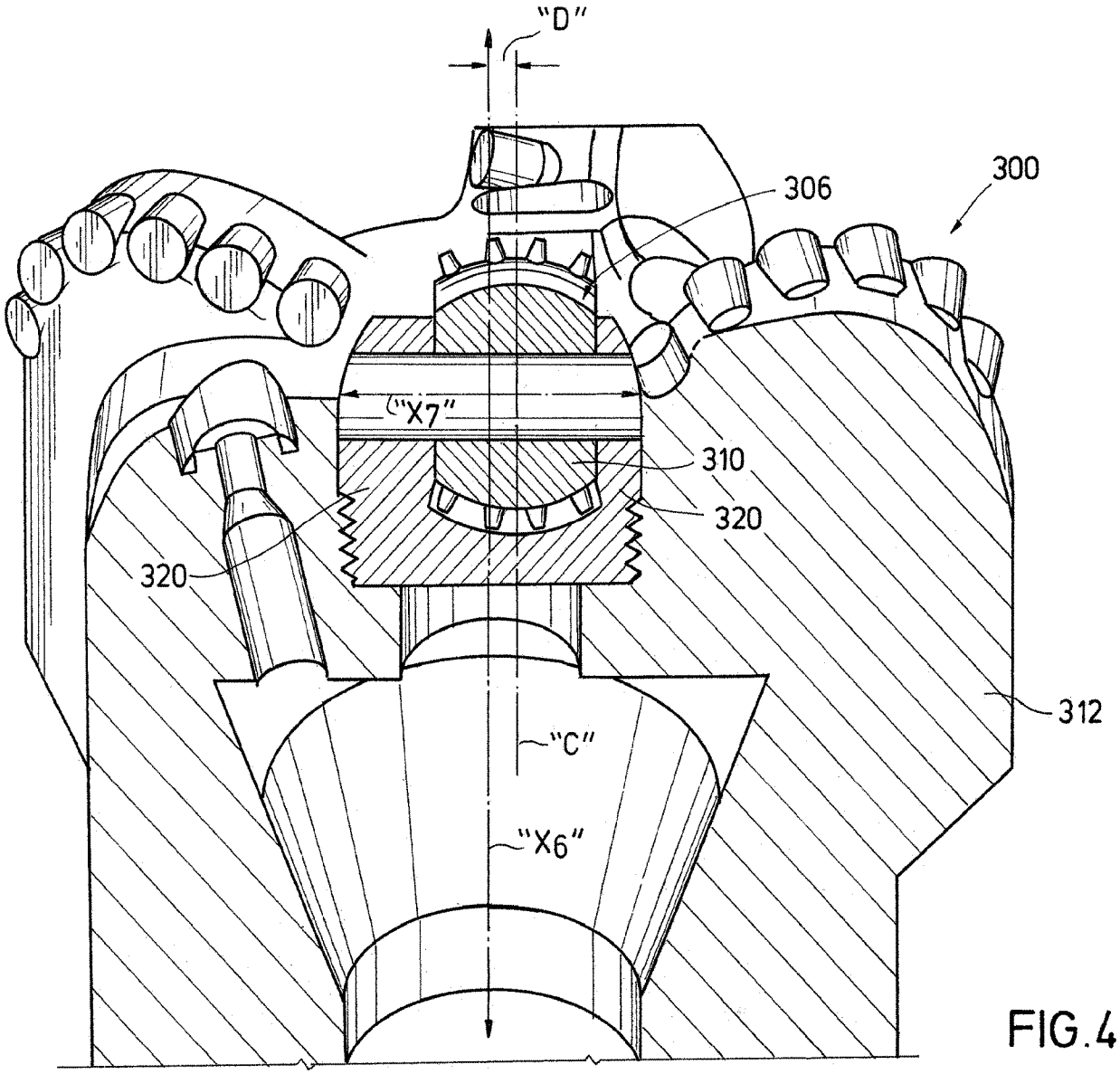
FIG. 4B is a partial cross-sectional view of another example of a hybrid drill bit illustrating a centrally-located rotational cutting structure having a single rotational cutting member mounted in a radially offset manner with respect to a rotational axis of the hybrid drill bit.

FIG. 4B is a partial cross-sectional view of another example of a hybrid drill bit 300 illustrating a centrally-located rotational cutting structure 306 having a single rotational cutting member 310 thereon. The rotational cutting member 310 is mounted in a radially offset manner with respect to a bit body rotational axis "$X_6$" defined by a bit body 312 of the hybrid drill bit 300. Axle supports 320 of the rotational cutting structure 306 maintain a centerline "C" of the counter-rotational cutting member 310 radially offset from the bit body rotational axis "$X_6$" by an offset distance "D." Thus rotation of the bit body 312 adjacent the geologic formation "G" (FIG. 1) induces rotation of the rotational cutting member 310 about a roller axis "$X_7$," which may be generally orthogonal to the bit body rotational axis "$X_6$." The rotational cutting member 310 intersects the bit body rotational axis "$X_6$" such that the rotational cutting member 310 extends to opposite radial sides of the bit body rotational axis "$X_6$."

4. Aspects of the Disclosure

The aspects of the disclosure described in this section are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a drill bit for forming a wellbore through a geologic formation. The drill bit includes a connector configured for connection to a drillstring and a bit body coupled to the connector. The bit body defines a bit body rotational axis extending longitudinally therethrough. The drill bit further includes a peripherally-located fixed cutting structure on the bit body and a centrally-located counter-rotational cutting structure. The peripherally-located fixed cutting structure includes at least one fixed cutting element thereon for rotation with the bit body about the bit body rotational axis. The centrally located counter-rotational cutting structure includes two counter-rotational cutting members mounted about respective roller axes that are generally perpendicular to the bit body rotational axis.

In one or more exemplary embodiments, the two counter-rotational cutting members are mounted for counter rotation with respect to one another in response to rotation of the bit body about the bit body rotational axis. In one or more exemplary embodiments, the centrally-located counter-rotational cutting structure includes a generally spherical profile across a leading end thereof. The respective roller axes of the counter-rotational cutting members may be substantially aligned such that the two counter-rotational cutting members are rotatable about a common axis extending generally perpendicular to the bit body rotational axis. Alternatively, the respective roller axes can be offset from one another such that the two counter-rotational cutting members are rotatable about distinct axes extending generally perpendicular to the bit body rotational axis. In some embodiments, distinct and offset roller axes may be axially offset from one another along the bit body rotational axis. In some embodiments, the two counter-rotational cutting members are mounted to extend to opposite radial sides of the bit body rotational axis.

In some embodiments, the centrally-located counter-rotational cutting structure may include a coupler thereon for coupling the counter-rotational cutting structure into a central aperture defined in the bit body. The coupler may include a first threaded surface thereon for engaging a corresponding second threaded surface defined in the central aperture. In some embodiments, the coupler may include fixed couplers such as welds or adhesives, and in other embodiments, the coupler may include removable couplers such as pins or latches to facilitate removal of the counter-rotational cutting structure from the central aperture. In some exemplary embodiments, the counter-rotational cutting structure comprises an axle supporting the two counter-rotational cutting members thereon.

In one or more exemplary embodiments, the peripherally-located fixed cutting structure includes a plurality of cutting blades circumferentially spaced about centrally-located counter-rotational cutting structure. The peripherally-located fixed cutting structure may include a plurality of radially and axially distributed fixed-cutting elements, and in some embodiments, the leading end of the counter-rotational cutting members are axially disposed to lead at least one of the fixed cutting elements and to trail at least one of the fixed cutting elements. In some embodiments, the leading end of the centrally-located counter-rotational cutting structure may be disposed on a leading axial side of a radially-inner-most fixed cutting element and on a trailing axial side of an axially leading-most fixed cutting element. In some exemplary embodiments, the centrally-located counter-rotational cutting structure may be under exposed such that the leading end is disposed on a trailing axial side of each of the fixed cutting elements, and in other embodiments, the counter rotational cutting structure may be over-exposed such that the leading end is disposed on a leading axial side of each of the fixed cutting elements.

In another aspect, the disclosure is directed to a drill bit for forming a wellbore through a geologic formation. The drill bit includes a connector configured for connection into a drillstring. A bit body is coupled to the connector and defines a rotational axis extending longitudinally through the bit body. The drill bit further includes a fixed cutting structure defined on the bit body that includes at least one fixed cutting element thereon for rotation with the bit body about the rotational axis. The drill bit also includes a rotational cutting structure including at least one rotational cutting member mounted on an axis generally perpendicular to the bit body rotational axis. The rotational cutting member is radially offset from the bit body rotational axis.

In some exemplary embodiments, the at least one fixed cutting element of the fixed cutting structure includes a plurality of fixed-cutting elements circumferentially spaced from one another on a radially outer side of the counter-rotational cutting structure. In some embodiments, the centrally-located rotational cutting structure protrudes from a central aperture defined in the bit body radially within the plurality of fixed-cutting elements.

In one or more embodiments, the at least one rotational cutting member includes two counter-rotational cutting members mounted to extend to opposite radial sides of the bit body rotational axis. In some exemplary embodiments, the two counter-rotational cutting members each have a generally hemispherical profile, and in some embodiments, the two counter-rotational cutting members are oriented with respect to one another to define a generally spherical profile across a leading end of the rotational cutting structure. In some exemplary embodiments, an apex of the generally spherical profile is disposed generally along the bit body rotational axis.

In some embodiments, the two counter-rotational cutting members are mounted on a common axis. In some embodiments, the at least one counter-rotational cutting member intersects the rotational axis and extends to opposite radial sides of the bit body rotational axis.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A drill bit for forming a wellbore through a geologic formation, the drill bit comprising:

a connector configured for connection to a drillstring, a bit body coupled to the connector and defining a bit body rotational axis extending longitudinally therethrough;

a peripherally-located fixed cutting structure on the bit body and including at least one fixed cutting element thereon for rotation with the bit body about the bit body rotational axis; and a centrally-located counter-rotational cutting structure comprising two counter-rotational cutting members mounted about respective roller axes generally perpendicular to the bit body rotational axis;

wherein the peripherally-located fixed cutting structure includes a plurality of radially and axially distributed fixed-cutting elements, and wherein a leading end of the centrally-located counter-rotational cutting structure is disposed on a leading axial side of a radially-inner-most fixed cutting element; and wherein the leading end of the centrally-located counter-rotational cutting structure is disposed on a trailing axial side of an axially leading-most fixed cutting element.

2. The drill bit of claim 1, wherein the centrally-located counter-rotational cutting structure comprises a generally spherical profile across a leading end thereof.

3. The drill bit of claim 1, wherein the respective roller axes are aligned such that the two counter-rotational cutting members are rotatable about a common roller axis extending generally perpendicular to the bit body rotational axis.

4. The drill bit of claim 3, wherein the two counter-rotational cutting members extend to opposite radial sides of the bit body rotational axis.

5. The drill bit of claim 1, wherein the respective roller axes are offset from one another such that the two counter-rotational cutting members are rotatable about distinct axes extending generally perpendicular to the bit body rotational axis.

6. The drill bit of claim 5, wherein the respective roller axes are axially offset from one another along the bit body rotational axis.

7. The drill bit of claim 1, wherein the centrally-located counter-rotational cutting structure includes a coupler thereon for coupling the centrally-located counter-rotational cutting structure into a central aperture defined in the bit body.

8. The drill bit of claim 7, wherein the coupler comprises a first threaded surface for engaging a corresponding second threaded surface defined in the central aperture.

9. The drill bit of claim 1, wherein the centrally-located counter-rotational cutting structure comprises an axle supporting the two counter-rotational cutting members thereon.

10. The drill bit of claim 1, wherein the peripherally-located fixed cutting structure comprises a plurality of cutting blades circumferentially spaced about centrally-located counter-rotational cutting structure.

11. A drill bit for forming a wellbore through a geologic formation, the drill bit comprising:

a connector configured for connection into a drillstring, a bit body coupled to the connector and defining a bit body rotational axis extending longitudinally through the bit body;

a fixed cutting structure defined on the bit body and including at least one fixed cutting element thereon for rotation with the bit body about the rotational axis; and a rotational cutting structure comprising at least one rotational cutting member radially offset from the bit body rotational axis mounted on a roller axis generally perpendicular to the bit body rotational axis;

wherein the two counter-rotational cutting members are oriented with respect to one another to define a generally spherical profile across a leading end of the rotational cutting structure; and wherein an apex of the generally spherical profile is disposed generally along the bit body rotational axis.

12. The drill bit of claim 11, wherein the at least one fixed cutting element of the fixed cutting structure comprises a plurality of fixed-cutting elements circumferentially spaced from one another on a radially outer side of the counter-rotational cutting structure.

13. The drill bit of claim 12, wherein the rotational cutting structure protrudes from a central aperture defined in the bit body radially within the plurality of fixed-cutting elements.

14. The drill bit of claim 11, wherein the at least one rotational cutting member comprises two counter-rotational cutting members mounted to extend to opposite radial sides of the bit body rotational axis.

15. The drill bit of claim 14, wherein the two counter-rotational cutting members each have a generally hemispherical profile.

16. The drill bit of claim 11, wherein the at least one rotational cutting member includes a generally cylindrical surface mounted for rotation about the roller axis.

17. A drill bit for forming a wellbore through a geologic formation, the drill bit comprising:

a connector configured for connection to a drillstring, a bit body coupled to the connector and defining a bit body rotational axis extending longitudinally therethrough;

a peripherally-located fixed cutting structure on the bit body and including at least one fixed cutting element thereon for rotation with the bit body about the bit body rotational axis; and a centrally-located counter-rotational cutting structure comprising two counter-rotational cutting members mounted about respective roller axes generally perpendicular to the bit body rotational axis wherein the respective roller axes are offset from one another such that the two counter-rotational cutting members are rotatable about distinct axes extending generally perpendicular to the bit body rotational axis and wherein the respective roller axes are axially offset from one another along the bit body rotational axis.

18. The drill bit of claim 17, wherein a leading end of the centrally-located counter-rotational cutting structure is disposed on a trailing axial side of an axially leading-most fixed cutting element disposed on the peripherally-located fixed cutting structure.

* * * * *